United States Patent [19]

Lazarus et al.

[11] 4,111,821

[45] Sep. 5, 1978

[54] LUBRICANTS FOR RECIPROCATING COMPRESSORS FOR OXYGEN-FREE GASES

[75] Inventors: Allan K. Lazarus, Lawrenceville; Malcolm H. Knapp, Bridgewater, both of N.J.

[73] Assignee: Tenneco Chemicals, Inc., Saddle Brook, N.J.

[21] Appl. No.: 594,179

[22] Filed: Jul. 8, 1975

Related U.S. Application Data

[63] Continuation-in-part of Ser. No. 224,223, Feb. 7, 1972, abandoned.

[51] Int. Cl.[2] ..... C10M 1/10

[52] U.S. Cl. ..... 252/49.9; 252/32.5; 252/34.7; 252/56 S

[58] Field of Search ..... 252/32.5, 34.7, 49.9, 252/565, 57, 51.5 A, 51.5 R

[56] References Cited

U.S. PATENT DOCUMENTS

| | | | |
|---|---|---|---|
| 3,203,895 | 8/1965 | Latos et al. | 252/49.9 X |
| 3,247,111 | 4/1966 | Oberright et al. | 252/34.7 |
| 3,476,685 | 11/1969 | Oberender et al. | 252/49.9 X |
| 3,567,636 | 3/1971 | Katzenstein | 252/32.5 |
| 3,912,640 | 10/1975 | Anzenberger | 252/56 S X |

OTHER PUBLICATIONS

Murphy et al., "Ind. Eng. Chem.", vol. 42, (1950), pp. 2415 to 2420.

"Lubrication", Apr., 1962, vol. XLVIII, No. 4, pp. 45–56.

*Primary Examiner*—Delbert E. Gantz
*Assistant Examiner*—Andrew H. Metz
*Attorney, Agent, or Firm*—Evelyn Berlow

[57] ABSTRACT

Lubricant compositions for use in the cylinder and drive train lubrication of reciprocating compressors for oxygen-free gases comprise 97% to 99% by weight of a base fluid that is a phthalate ester of an aliphatic alcohol having 10 to 15 carbon atoms and 1% to 3% by weight of an additive system that contains a viscosity index modifying component, an antioxidant component, and optionally a corrosion inhibitor and/or a load bearing additive.

7 Claims, No Drawings

LUBRICANTS FOR RECIPROCATING COMPRESSORS FOR OXYGEN-FREE GASES

This is a continuation-in-part of our copending application Ser. No. 224,233, which was filed on Feb. 7, 1972 and now abandoned.

This invention relates to lubricant compositions for reciprocating gas compressors. More particularly, it relates to lubricant compositions for the cylinders and drive trains of reciprocating compressors for oxygen-free gases.

Lubricants that are to be used in reciprocating gas compressors must fill two separate functions: they must provide lubrication for the crankshaft and other portions of the drive train and transmission parts of the compressor, and they must provide lubrication for the compression chamber. The lubrication of the drive train and transmission parts of the compressor requires an extremely stable material that retains its viscosity and lubricating properties under various extreme conditions. Materials that meet this requirement are the high-performance ester-based lubricants that are disclosed in the prior art as being useful as turbine engine lubricants and as meeting military specifications for jet aircraft engines. The second function, that is, lubrication of the compression chamber, is unique to this type of compressor. Unlike lubricants for internal combustion engines, the cylinder lubricant in reciprocating gas compressors is injected into the piston chamber; it is not recycled, but is lost with the compressed exhaust gas. Thus, lubricants for these compressors must not only have high resistance to degradation under the conditions of temperature and pressure encountered in the piston chamber and between the piston and side walls of the chamber, but they must also not form sludge or varnish in the valve, and they must be effective in very small amounts in order to avoid excessive contamination of the exhaust compressed gas. In addition, lubricants for reciprocating compressors for such oxygen-free gases as hydrocarbon gases and chlorine must have extremely low vapor pressure as well as good viscosity stability.

Until the present time, the only lubricants that have been used in reciprocating compressors for non-oxygen-containing gases have been natural hydrocarbon lubricants. Petroleum-based lubricants, however, must be used in amounts that cause excessive sludge and varnish deposits to form in the cylinders, valves, and crankcases of the compressors and thus make necessary frequent shutdowns for extensive and expensive cleaning.

In accordance with this invention, it has been found that lubricant compositions that contain a phthalate ester of an aliphatic alcohol having 10 to 15 carbon atoms as the base fluid and a particular additive system meet all of the requirements that have been established for lubricants that are to be used in reciprocating compressors for non-oxygen-containing gases. Because they are stable compositions that retain their viscosity and lubricating properties under extreme conditions, they are excellent lubricants for the crankshaft, drive train, and transmission portions of the compressors. Because they are effective lubricants when used in very small quantities, they cause little contamination of the exhaust gas; because they produce only small amounts of sludge and varnish, they are exceptionally valuable as chamber lubricants.

While the novel lubricant compositions can be used in reciprocating gas compressors that are used to compress air or other oxygen-containing gases, they are of particular value as lubricants for reciprocating gas compressors that are used to compress a wide variety of non-oxygen-containing gases. Unlike petroleum-based lubricants and the previously-known synthetic ester-based lubricant compositions, the lubricant compositions of this invention can be used in reciprocating compressors for non-oxygen-containing gases for long periods of time without shutdowns that are necessary to remove the sludge deposits that result in a decrease in compressor efficiency and that result in a sizeable loss of production.

Especially advantageous results have been obtained when the lubricant compositions of this invention were used in reciprocating compressors that were compressing one or more of the following gases: saturated and unsaturated hydrocarbons having 1 to 26 carbon atoms, fluorochlorohydrocarbons, methanol, combustion gases, nitrogen, chlorine, ammonia, carbon monoxide, carbon dioxide, and the like.

The lubricant compositions of this invention contain from about 97% to 99% by weight, and preferably 97.5% to 98.5% by weight, of a phthalate ester of an aliphatic alcohol having 10 to 15 carbon atoms and 1% to 3% by weight, and preferably 1.5% to 2.5% by weight, of an additive system that contains (a) a viscosity index modifier, (b) an antioxidant component, and (c) a corrosion inhibitor and/or a load carrying additive.

Illustrative of the phthalate esters that can be used as the base fluid in the lubricant compositions of this invention are the following: bis(decyl) phthalate, bis(undecyl) phthalate, bis(dodecyl) phthalate, bis(tridecyl) phthalate, bis(pentadecyl) phthalate, undecyl tridecyl phthalate, decyl tetradecyl phthalate, bis(isotridecyl) phthalate, bis(isotetradecyl) phthalate, bis($C_{12}$-"oxo") phthalate, bis($C_{13}$"oxo") phthalate, and the like. A single phthalate ester or a mixture of two or more of these esters can be used. The preferred base fluids are phthalate esters of branched-chain and straight-chain aliphatic alcohols having 10 to 13 carbon atoms, such as bis(tridecyl) phthalate.

The esters are prepared by procedures that are well known in the art. For example, they can be prepared by the direct esterification of phthalic acid or anhydride with a substantially equivalent amount of the alcohol in the presence of an acidic catalyst, such as sulfuric acid or p-toluenesulfonic acid.

To form lubricant compositions, the phthalate esters are blended with an additive system, each component of which is included to impart a particular characteristic to the composition. The additive system that is used in lubricant compositions that are intended for use in reciprocating compressors for oxygen-free gases consist essentially of (a) 0.2% to 0.8% of a viscosity index modifier, (b) 0.8% to 2.0% of an antioxidant component, (c) 0 to 0.1% of a monocarboxylate of 1-salicylalaminoguanidine, and (d) 0 to 0.5% of a phosphate ester as hereinafter defined, all percentages being percentages by weight based on the weight of the lubricant composition. It preferably contains (a) 0.3% to 0.5% of a viscosity index modifier, (b) 0.8% to 1.2% of a phenolic antioxidant, (c) 0 to 0.8% of an amine antioxidant, and (d) 0.01% to 0.05% of a monocarboxylate of 1-salicylalaminoguanidine and/or 0.05% to 0.2% of a phosphate ester, all percentages being percentages by weight based on the weight of the lubricant composition.

The viscosity index modifier is used to increase the viscosity or the viscosity index of the base fluid. Because their resistance to sludge formation under the conditions of use is far superior to that of the other polymeric esters that have been used heretofore for this purpose, the preferred viscosity index modifiers are copolymers of alkyl acrylates, copolymers of alkyl methacrylates, and mixtures thereof. Best results have been obtained when the viscosity index modifier was a copolymer that contained a major proportion of an alkyl methacrylate, such as decyl methacrylate, lauryl methacrylate, cetyl methacrylate, or stearyl methacrylate, and a minor proportion of N-vinylpyrrolidone in the copolymer molecule.

The antioxidant component of the additive system contains a phenolic antioxidant alone or in combination with a secondary or tertiary amine antioxidant. The useful phenolic antioxidants are those in which the combined bulk of all substituents ortho to the hydroxyl group is sufficient to block the hydroxyl group by steric hindrance. These hindered phenol antioxidants include such monocyclic phenols and bis phenols as 2,6-di-tert-.butyl-p-cresol, 2,6-di-tert.butyl-4-benzylphenol, 2,6-di-tert.butyl-α-dimethylamino-p-cresol, 4,4'-methylene bis-(2,6-di-tert.butylphenol), 2,2'-methylene bis-(4-ethyl-6-tert.butylphenol), 4,4'-methylene bis-(6-tert.butyl-5-indanol), and 1,3,5-trimethyl-2,4,6-tris(3,5-di-tert-.butyl-4-hydroxybenzyl)benzene.

The amine antioxidants that may be present in the antioxidant component of the additive system have the structural formula

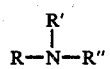

wherein R and R' are each phenyl, alkylphenyl, naphthyl, or alkylnaphthyl, and R'' is hydrogen, alkyl, phenyl, alkylphenyl, naphthyl, or alkylnaphthyl. Examples of these amines include N-phenyl-α-naphthylamine, diphenylamine, dinaphthylamine, ditolylamine, p,p'-dioctyldiphenylamine, diphenyloctylamine, and triphenylamine. When an amine antioxidant is used, it is preferably present in the amount of 0.1% to 0.5%, based on the weight of the lubricant composition.

Monocarboxylates of 1-salicylalaminoguanidine may be included in the additive system to reduce the corrosion of copper engine parts when they are exposed to the lubricant compositions for long periods of time at high temperatures and in the presence of air. The preferred monocarboxylates of 1-salicylalaminoguanidine are salts of fatty acids having 6 to 30 carbon atoms, for example, caproic acid, caprylic acid, capric acid, lauric acid, stearic acid, oleic acid, and the like.

The additive system may also contain a load carrying additive that is a phosphate ester. Among the preferred phosphate esters for use in the lubricant compositions of this invention are the commercially-available products that comprise either phosphate esters of ethoxylated aliphatic and aromatic alcohols, ammonium salts of phosphate esters and mixtures thereof.

The components of the additive system may be added to the base fluid individually or in combination as ingredients in a pre-blended additive package.

The lubricant compositions can be applied to the cylinder and drive train of a reciprocating compressor by any suitable and convenient procedures. Generally, separate lubricant reservoirs are provided for the cylinder and drive train because under some conditions it may be desirable to use a less expensive lubricant alone or in combination with the novel lubricants for the drive train.

The lubricant composition can be fed to the cylinder of the reciprocating compressor by a pressure feed system or by a vacuum feed system that utilizes a double acting piston. In the latter, which is more accurate feed system, on the first stroke of the piston the lubricant is drawn into a barrel by the vacuum created by withdrawing the piston. The lubricant is then forced from the barrel to the cylinder on the return stroke of the piston.

The invention is further illustrated by the following examples.

EXAMPLE 1

A. A base lubricant composition was prepared by mixing 97.9 parts by weight of bis(tridecyl) phthalate with 0.4 part by weight of a copolymer of N-vinylpyrrolidone and lauryl methacrylate. This base lubricant composition had a pourpoint of −30° C., a viscosity at 210° F. of 9.5 centistokes, a viscosity at 100° F. of 108 centistokes, and a viscosity index of 63.

To this base lubricant composition were added 1.0 part by weight of 4,4'-methylene bis(2,6-di-tert.butylphenol), 0.5 part by weight of N-phenyl-alpha-naphthylamine, and 0.2 part by weight of a mixture of 10% by weight of 1-salicylalaminoguanidine monooleate and 90% by weight of diphenylamine.

B. The lubricant whose preparation is described in Example 1A was compared with a previously-acceptable petroleum hydrocarbon lubricant in a Worthington WTC-1750 reciprocating compressor, which was being used to compress "crack gas," which had the following composition:

| | % by Weight |
|---|---|
| Hydrogen and Methane | 50 |
| Ethylene | 30 |
| Ethane | 10 |
| Acetylene | 2 |
| $C_3$ Hydrocarbons | 3 |
| $C_{4-26}$ Hydrocarbons | 5 |

When the petroleum-based lubricant was used to lubricate the drive train and the cylinder of the compressor, large amounts of deposits formed on the compressor valves and in the air passages of the compressor. These deposits consisted of polymerized hydrocarbons from the crack gas and degraded mineral oil from the cylinder lubricant. Because of the formation of these deposits, the compressor had to be shut down at approximately monthly intervals for overhaul and extensive cleaning. These frequent stoppages also resulted in a considerable loss of production. In addition, toward the end of each monthly cycle, the build-up of deposits caused a decrease in compressor efficiency and a rise in the discharge temperature which resulted occasionally in dangerous and damaging explosions.

When the petroleum-based lubricant was replaced by the lubricant composition whose preparation is described in Example 1, the compressor was used to compress the "crack gas" continuously for more than 4 months. Inspections were made at frequent intervals. After the lubricant of this invention had been used as the cylinder lubricant for 17 weeks, the amount of material deposited on the compressor valves was about one half of that deposited in 3 weeks by the petroleum-based lubricant. The oxidative stability of the diester-based lubricant and its solvency had resulted in a ten-fold improvement in performance over that obtained using a petroleum-based lubricant.

EXAMPLE 2

A. A base lubricant composition was prepared by mixing 98.5 parts by weight of bis(tridecyl) phthalate with 0.4 part by weight of a copolymer of N-vinylpyrrolidone and lauryl methacrylate.

To this base lubricant composition were added 1.0 part by weight of 4,4'-methylene bis(2,6-di-tert.butylphenol) and 0.1 part by weight of an ammonium salt of a phosphate ester that has the structural formula

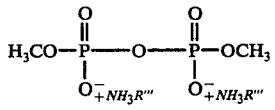

wherein each R''' is a tertiary alkyl group having 12 to 14 carbon atoms.

B. The effectiveness of this lubricant as a crankcase lubricant for a reciprocating compressor used for compressing chlorine was determined by bubbling a 5% mixture of chlorine in nitrogen through 600 ml. of the lubricant at 55° C. for 7 hours. At hourly intervals, samples were taken and evaluated for viscosity increase and the presence of precipitates. At the end of seven hours, the viscosity of the lubricant whose preparation is described in Example 2A had increased by less than 6%, and the lubricant contained no precipitate. In a comparative test, a mineral oil-based lubricant underwent an increase of more than 30% in its viscosity during the 7-hour treatment with chlorine, but it did not form precipitates.

EXAMPLE 3

A. A base lubricant composition was prepared by mixing 97.8 parts by weight of bis(tridecyl) phthalate with 0.4 part by weight of a copolymer of lauryl methacrylate and N-vinylpyrrolidone.

To this base lubricant composition was added 1.0 part by weight of 4,4'-methylene bis-(2,6-di-tert.butylphenol), 0.2 part by weight of a mixture of 10% of 1-salicylalaminoguanidine monooleate and 90% of diphenylamine, and 0.1 part by weight of a phosphate ester of ethoxylated aliphatic and aromatic alcohols.

B. The lubricant composition whose preparation is described in Example 3A was evaluated in a large multistage compressor, which is part of a cascade refrigeration system using methane, ethylene, and propane as the refrigerant gases. For comparative purposes, a mineral oil-based lubricant was also evaluated in the same compressor.

When the mineral oil-based lubricant was used, problems involving high lubricant consumption and inadequate lubrication were encountered. These problems did not arise when the lubricant of this invention was used.

The substantial improvements in performance that occurred when the novel lubricant was used probably result from the extremely low vapor pressure and the good lubricity of the lubricant compositions of this invention. The vapor pressures of a typical petroleum-based compressor lubricant and two of the lubricants of this invention are shown in the following table:

| | Vapor Pressure, mm Hg | | |
|---|---|---|---|
| Temperature (° F.) | Product of Ex. 1A | Product of Ex. 3A | Petroleum Oil (Viscosity of 16 cSt. at 210° F.) |
| 50 | $1 \times 10^{-6}$ | $1 \times 10^{-6}$ | $2 \times 10^{-5}$ |
| 100 | $1 \times 10^{-5}$ | $1 \times 10^{-5}$ | $3 \times 10^{-4}$ |
| 150 | $1 \times 10^{-4}$ | $1 \times 10^{-4}$ | $4 \times 10^{-3}$ |
| 200 | $1 \times 10^{-3}$ | $1 \times 10^{-3}$ | $3 \times 10^{-2}$ |
| 300 | $3.0 \times 10^{-2}$ | $3.5 \times 10^{-2}$ | $7 \times 10^{-1}$ |
| 400 | $3.8 \times 10^{-1}$ | $4.8 \times 10^{-1}$ | 9.0 |
| 500 | 3.5 | 4.4 | 8.0 |

What is claimed is:

1. A lubricant composition for use in the cylinder and drive train lubrication of reciprocating compressors for oxygen-free gases that comprises
   (a) 97% to 99% of a bis(alkyl) phthalate wherein each alkyl group has 10 to 15 carbon atoms and
   (b) 1% to 3% of an additive system that comprises
      (i) 0.2% to 0.8% of a copolymer of an alkyl methacrylate and N-vinylpyrrolidone;
      (ii) 0.8% to 2.0% of an antioxidant component that contains
         ((a)) 0.8% to 1.2% of an hindered phenol antioxidant wherein the hindering groups are alkyl groups having 1 to 4 carbon atoms and
         ((b)) 0 to 0.8% of at least one hydrocarbyl secondary or tertiary amine antioxidant;
      (iii) 0 to 0.1% of a fatty acid monocarboxylate of 1-salicylalaminoguanidine; and
      (iv) 0 to 0.5% of an ammonium salt of a phosphate ester, all percentages being percentages by weight based on the weight of the lubricant composition.

2. A lubricant composition as defined in claim 1 wherein the phthalate ester is bis(tridecyl) phthalate.

3. A lubricant composition as defined in claim 1 wherein the viscosity index modifier is a copolymer of lauryl methacrylate and N-vinyl-pyrrolidone.

4. A lubricant composition as defined in claim 1 wherein the hindered phenol antioxidant is 4,4'-methylene bis-(2,6-di-tert.butylphenol).

5. A lubricant composition as defined in claim 1 that consists essentially of
   (a) 97.5% to 98.5% of bis(tridecyl) phthalate;
   (b) 0.3% to 0.5% of a copolymer of lauryl methacrylate and N-vinylpyrrolidone;
   (c) 0.8% to 1.2% of 4,4'-methylene bis-(2,6-di-tert-.butylphenol); and
   (d) 0.05% to 0.2% of a phosphate ester having the structural formula

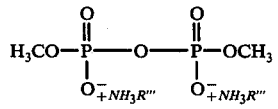

wherein each R''' is a tertiary alkyl group having 12 to 14 carbon atoms, all percentages being percentages by weight based on the weight of the lubricant composition.

6. The method of lubricating a reciprocating compressor for oxygen-free gases that comprises feeding to the cylinder and drive train of said compressor from at least one reservoir a lubricant composition that comprises
   (a) 97% to 99% of a bis(alkyl)phthalate wherein each alkyl group has 10 to 15 carbon atoms and (b) 1% to 3% of an additive system that comprises
(i) 0.2% to 0.8% of a copolymer of an alkyl methacrylate and N-vinylpyrrolidone;
(ii) 0.8% to 2.0% of an antioxidant component that contains
((a)) 0.8% to 1.2% of a hindered phenol antioxidant in which the hindering groups are alkyl groups having 1 to 4 carbon atoms and
((b)) 0 to 0.8% of at least one hydrocarbyl secondary or tertiary amine antioxidant;
(iii) 0 to 0.1% of a fatty acid monocarboxylate of 1-salicylalaminoguanidine; and
(iv) 0 to 0.5% of an ammonium salt of a phosphate ester, all percentages being percentages by weight based on the weight of the lubricant composition.

7. The method of claim 6 wherein the lubricant composition consists essentially of
(a) 97.5% to 98.5% of bis(tridecyl) phthalate,
(b) 0.3% to 0.5% of a copolymer of lauryl methacrylate and N-vinylpyrrolidone,
(c) 0.8% to 1.2% of 4,4'-methylene bis-(2,6-di-tert-.butylphenol); and
(d) 0.05% to 0.2% of a phosphate ester having the structural formula

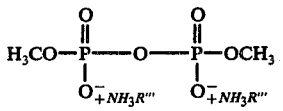

wherein each R''' is a tertiary alkyl group having 12 to 14 carbon atoms,
all percentages being percentages by weight based on the weight of the lubricant composition.

* * * * *